US008499962B1

(12) United States Patent
Martin et al.

(10) Patent No.: US 8,499,962 B1
(45) Date of Patent: Aug. 6, 2013

(54) RAIL CAR UNLOADING CATCH PAN SYSTEM

(75) Inventors: Ronald R. Martin, Bremen, GA (US); Zachary W. Butterworth, Heflin, AL (US); Joel R. Dicks, Carrollton, GA (US)

(73) Assignee: Southwire Company, Carrollton, GA (US)

( * ) Notice: Subject to any disclaimer, the term of this patent is extended or adjusted under 35 U.S.C. 154(b) by 1508 days.

(21) Appl. No.: 12/100,440

(22) Filed: Apr. 10, 2008

(51) Int. Cl.
*B65D 1/34* (2006.01)
*B65D 21/024* (2006.01)

(52) U.S. Cl.
USPC ..... 220/573; 220/4.03; 220/23.4; 220/571

(58) Field of Classification Search
USPC ..... 220/571, 573, 4.03
See application file for complete search history.

(56) References Cited

U.S. PATENT DOCUMENTS 5,492,158 A * 2/1996 Haag ..... 141/98
5,562,047 A * 10/1996 Forney et al. ..... 108/57.13
5,775,869 A * 7/1998 Bishop ..... 414/608
5,782,405 A 7/1998 Vincent
5,975,332 A * 11/1999 Bishop ..... 220/571
6,102,086 A * 8/2000 Holtby ..... 141/86
6,173,856 B1 1/2001 Bierce et al.
6,290,143 B1 9/2001 Vincent et al.
6,305,569 B1 10/2001 Bierce et al.
6,415,987 B2 7/2002 Vincent et al.
6,719,228 B2 * 4/2004 Berger et al. ..... 241/46.16
7,168,588 B2 * 1/2007 Van Romer ..... 220/571
7,290,558 B2 * 11/2007 DeChard et al. ..... 137/312
7,316,834 B2 * 1/2008 Hernandez ..... 428/60
2001/0048033 A1 12/2001 Vincent et al.
2006/0124650 A1 * 6/2006 Robinson ..... 220/571
2008/0116211 A1 * 5/2008 Ericson et al. ..... 220/660

* cited by examiner

*Primary Examiner* — Mickey Yu
*Assistant Examiner* — Niki Eloshway
(74) *Attorney, Agent, or Firm* — Hartman & Citrin LLC

(57) ABSTRACT

A system for catching and containing a spill of a liquid from a rail tank car consisting of a series of catch pans attached end-to-end and placed between the rails of a railroad track is provided. The end walls of each catch pan are shorter than its side walls, with the catch pans located at either end of the series having an end wall extension attached to raise the height of the end wall to that of the side walls. A sealing gasket is placed between adjacent catch pans, and at least one opening extends through the end walls and the sealing gasket between adjacent catch pans. A drain is located in the bottom of at least one of the catch pans.

13 Claims, 7 Drawing Sheets

RAIL CAR UNLOADING CATCH PAN SYSTEM

BACKGROUND

An industrial railroad siding where hazardous chemicals are loaded and unloaded from rail tank cars presents an environmental concern, in that an accidental spill of some or all of the contents of the rail tank car can occur. Typically, such spills can be divided into "nuisance spills," where a small quantity of chemicals escape the tank car during the connection or disconnection of hoses or from leaks in the hoses of the unloading system, and "catastrophic spills," where a hose ruptures or valve or coupling gives way and the entire contents of the tank car are released. A rail tank car may contain from 16,000 to 40,000 gallons of chemical and may have up to a 5" or larger discharge opening. In the event of a catastrophic spill, this volume of chemical may be rapidly released onto the rail bed and could quickly find its way into nearby streams or ground water. This could result in significant environmental damage, a costly cleanup, and stiff regulatory fines.

A common precaution in these situations is to install a containment system underneath the rail tank cars to capture any liquids spilled during loading and unloading, such as a series of catch pans installed on the rail bed between the rails of the siding. Typical catch pan systems, while perhaps adequate to contain most nuisance spills, cannot safely contain a catastrophic spill of a hazardous chemical. Typical catch pan system designs generally require each pan to have its own means for drainage, and these drains are usually not sufficiently large to handle the volume and rate of liquid being discharged from the typical discharge opening of a tank car, such as a 5" discharge opening. If the drain for a particular pan becomes blocked or overwhelmed by the flow rate liquid, the pan can quickly fill and potentially overflow onto the rail bed underneath.

SUMMARY

It should be appreciated that this Summary is provided to introduce a selection of concepts in a simplified form that are further described below in the Detailed Description. This Summary is not intended for use in limiting the scope of the claimed subject matter.

Apparatus and systems are described herein for catching and containing a spill of a liquid from a rail tank car located upon a railroad siding. In one embodiment, a catch pan system consists of a series of catch pans, each catch pan consisting of a bottom, side walls, and end walls, with the end walls being shorter than the side walls. The catch pans are sized such that they fit between the rails of the railroad track and are attached end-to-end and further attached to the cross-ties of the railroad track. A sealing gasket is placed between adjacent catch pans and at least one opening extends through each of the end walls and the sealing gasket between adjacent catch pans. The openings are configured to be of sufficient size to handle a maximum flow rate of liquid. In one embodiment, the openings are triangular in shape with a vertex located close to the bottom of the catch pan such that liquid may flow from pan to pan immediately. A drain is located in the bottom of at least one of the catch pans and leads to a drainage apparatus capable of capturing a maximum volume of liquid. The catch pans located at either end of the series of catch pans include an end wall extension attached to the end walls configured to extend the height of the end wall to that of the side walls.

According to further embodiments, the system additionally consists of a series of short side pans connected end-to-end and placed outside one of the rails, each short side pan having end walls shorter than the side walls. A sealing gasket is placed between adjacent short side pans and at least one opening extends through each of the end walls and the sealing gasket between adjacent short side pans. A drain is located in the bottom of at least one of the short side pans and leads to the drainage apparatus. In other embodiments, the system further consists of a series of tall side pans connected end-to-end and placed outside the other rail, each tall side pan having end walls shorter than the inside side wall, and having an outside side wall taller than the inside side wall. A sealing gasket is placed between adjacent tall side pans and at least one opening extends through each of the end walls and the sealing gasket between adjacent tall side pans. A drain is located in the bottom of at least one of the tall side pans and leads to the drainage apparatus. The short side and tall side pans located at either end of the series of pans include an end-wall extension attached to the end wall configured to extend the height of the end wall to that of the side walls.

Other apparatus and systems according to embodiments will be or become apparent to one with skill in the art upon review of the following drawings and Detailed Description. It is intended that all such additional apparatus and/or systems be included within this description, be within the scope of the present invention, and be protected by the accompanying claims.

DETAILED DESCRIPTION

The following detailed description is directed to a catch pan system for catching and containing a spill of a liquid from a rail tank car located upon a railroad siding. As discussed briefly above, typical catch pan systems are generally not designed to safely contain a catastrophic spill of a hazardous chemical. Rather, these catch pan systems generally require each pan to have its own means for drainage, and these drains are usually not of a sufficient size to handle the potential 40,000 gallon volume and flow rate of a viscous chemical being discharged from up to a 5" discharge opening of a tank car. If the drain for a particular pan becomes blocked or overwhelmed by the flow rate of the chemical, the pan can quickly fill and potentially overflow onto the rail bed underneath.

However, embodiments of the disclosure provided below describe a catch pan system for catching and containing such a catastrophic spill of a hazardous chemical, consisting of a series of catch pans attached end-to-end with a sealing gasket placed between adjacent catch pans. At least one opening extends through each of the end walls and the sealing gasket between adjacent catch pans. The opening is of sufficient size to allow a liquid, such as a viscous chemical, discharged from a discharge opening of a container for retaining liquid, such as a tank car, to readily flow from pan to pan. According to exemplary embodiments, the opening is triangular in shape with a vertex located close to the bottom of the catch pan so that the chemical flows from pan to pan immediately. A drain is located in the bottom of at least one of the catch pans. The drain is of sufficient size to handle the flow of a viscous chemical discharged from the discharge opening and leads to a containment apparatus capable of containing the entire contents of a tank car.

According to exemplary embodiments, the end walls of each catch pan are shorter in height than its side walls, with the catch pans located at either end of the series of catch pans having an extension member attached that raises the height of the end wall to that of the side walls. Thus the system is configured such that chemical entering into any one catch pan can flow through the openings into adjacent catch pans or, if the openings between adjacent catch pans become blocked or overwhelmed by the flow of the chemical, the chemical in the catch pan can overflow the shorter end walls into adjacent catch pans without spilling over the side walls and onto the rail bed. In this way chemical entering into any catch pan can find its way to multiple drains located in adjacent catch pans in the system. This redundancy ensures a catastrophic spill of a hazardous chemical from a tank car can be safely caught and contained without the chemical spilling onto the rail bed and causing environmental damage.

Figure 1:
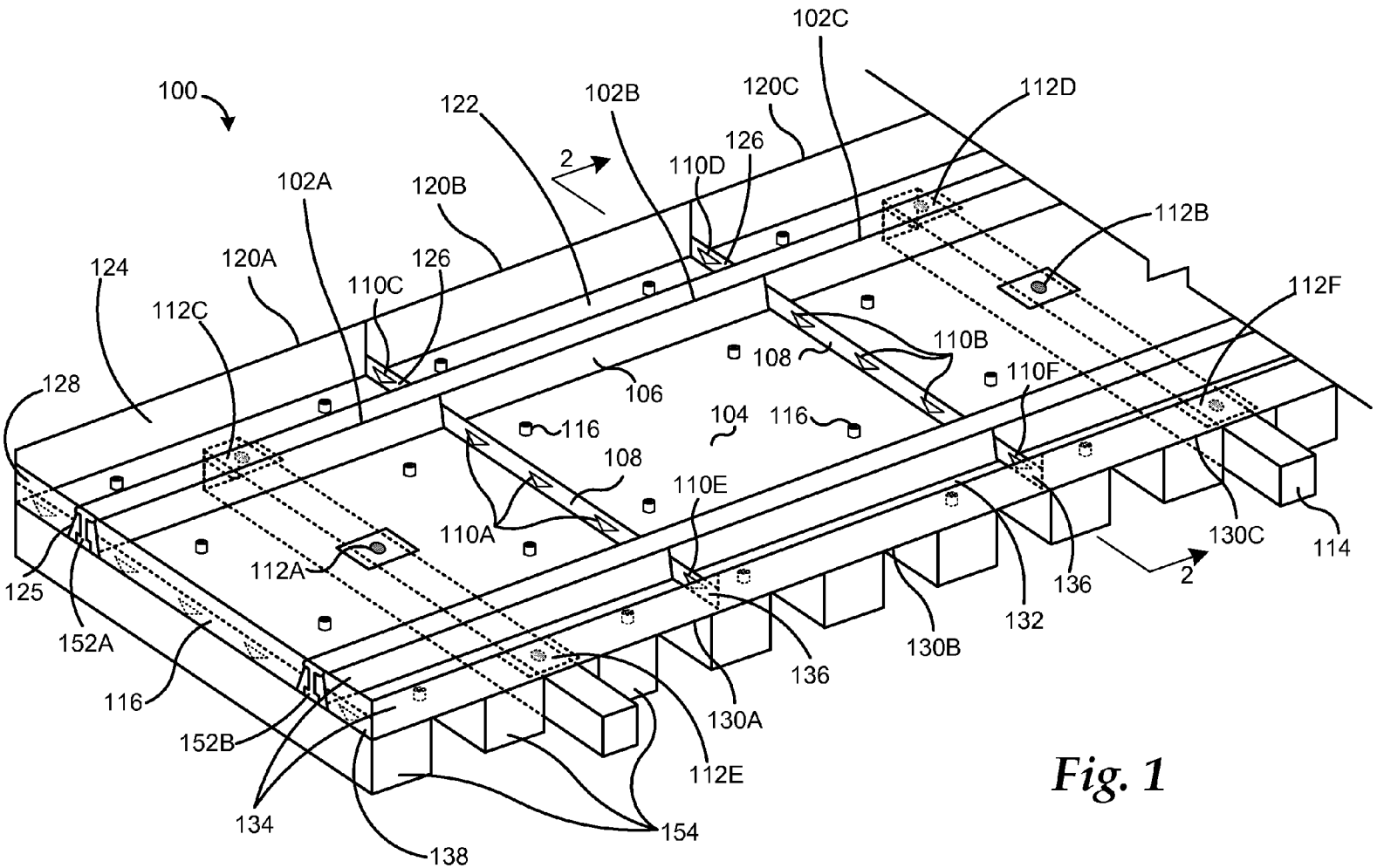
FIG. 1 is a perspective view of a catch pan system installed on a railroad siding, according to various embodiments presented herein.

In the following detailed description, references are made to the accompanying drawings that form a part hereof, and which are shown by way of illustration, specific embodiments, or examples. Referring now to the drawings, in which like numerals represent like elements through the several figures, aspects of a catch pan system for catching and containing a spill of a liquid from a rail tank car will be described. FIG. 1 shows a perspective view of a catch pan system 100 installed on a railroad siding, according to one embodiment. The catch pan system 100 consists of a series of center catch pans 102A, 102B, 102C (generally referred to herein as center catch pans 102), attached end-to-end and located between the rails 152A, 152B (generally referred to herein as rails 152) of the railroad siding. Each center catch pan 102A, 102B, 102C has a bottom 104, two side walls 106, and two end walls 108. In one embodiment, the bottom 104 of each center catch pan 102A, 102B, 102C rests upon the cross-ties 154 of the railroad siding and is affixed to the cross-ties 154 at various points by sealed connection members 116, described in detail below in regard to FIG. 5.

A drain 112A, 112B (generally referred to herein as drains 112) extends through the bottom 104 of at least one center catch pan, such as center catch pan 102C, and is connected to a drainage tube 114 which runs below the center catch pan 102C and between adjacent cross-ties 154 of the railroad siding. According to exemplary embodiments, the size of each drain 112A, 112B and drainage tube 114 is sufficient to handle the maximum flow rate of a liquid from up to a 5" discharge opening of a rail tank car or any other type of container of liquids, as well as rain water entering the center catch pans 102A, 102B, 102C during a rainstorm. The drains 112A, 112B and drainage tube 114 may further be sized to handle the maximum flow rate of a liquid from a larger or smaller discharge opening of a rail tank car or other type of container for retaining liquid. In one embodiment, the drainage tube is square in shape to maximize the cross-sectional area of the tube that can be placed between adjacent cross-ties 154, thus maximizing the flow capacity of liquid in the drainage tube 114. The drainage tube 114 is connected to a containment means (not shown) capable of containing the maximum contents of a rail tank car. According to exemplary embodiments, multiple center catch pans, such as the center catch pans 102A, 102C, within the catch pan system 100 include drains, such as the drains 112A, 112B, providing for redundancy.

At least one opening 110A, 110B (generally referred to herein as openings 110) extends through the end walls 108 of the adjacent center catch pans 102A, 102B, 102C. In accordance with exemplary embodiments, multiple openings 110A, 110B exist between the adjacent center catch pans 102A, 102B, 102C allowing for a maximum flow of liquid between the pans. In addition, the end walls 108 of each center catch pan 102A, 102B, 102C are shorter in height than the side walls 106. In the event that the openings 110A, 110B between the adjacent center catch pans 102A, 102B, 102C were to become blocked or overwhelmed by the flow of liquid, the liquid in the center catch pans can overflow the shorter end walls 108 into the adjacent center catch pans without spilling over the side walls 106 and onto the rail bed. Center catch pans located at either end of the series of center catch pans, such as the center catch pan 102A, have an end plate 116 attached to their non-adjacent end walls 108 that raises the height of the end wall 108 to that of the side walls 106, according to exemplary embodiments.

The primary effect of this configuration is that liquid entering any of the center catch pans 102A, 102B, 102C may flow from pan to pan within the catch pan system 100 in order to find its way to one of a number of available drains, such as drains 112A, 112B. For example, as illustrated in FIG. 1, liquid entering the center catch pan 102B may flow through the multiple openings 110A, or by overflowing the end walls 108 if the openings 110A become blocked or overwhelmed, into adjacent the center catch pan 102A and into the drain 112A located in the bottom of that pan. In addition, liquid entering the center catch pan 102B may also flow through the multiple openings 110B, or by overflowing the end walls 108 if the openings 110B become blocked or overwhelmed, into the adjacent center catch pan 102C and into the drain 112B located in the bottom of that pan. By providing redundant paths through each of the center catch pan 102A, 102B, 102C for liquid to flow to the multiple drains 112A, 112B, the catch pan system 100 ensures that a liquid entering any of the center catch pans 102A, 102B, 102C can be safely contained, even if one or more of the openings 110A, 110B or one of the available drains 112A, 112B is blocked or otherwise non-functional.

In a further embodiment, the catch pan system 100 includes a series of tall side pans 120A, 120B, 120C attached end-to-end and located outside one of the rails 152A of the railroad siding. Each tall side catch pan 120A, 120B, 120C has a bottom 122, an outside side wall 124, an inside side wall 125, and two end walls 126. The end walls 126 are shorter in height than the inside side wall 125, and the outside side wall 124 is taller in height than the height of the adjacent rail 152A. Tall side pans located at either end of the series of tall side pans, such as the tall side pan 120A, have an end plate 128 attached to their non-adjacent end walls 126 that raises the height of the end wall 126 to that of the inside side wall 125. Like the center catch pans 102A, 102B, 102C described above, the bottom 122 of each tall side pan 120A, 120B, 120C rests upon the cross-ties 154 of the railroad siding and is affixed to the cross-ties 154 at various points by the sealed connection members 116, described in detail below in regard to FIG. 5.

A drain 112C, 112D extends through the bottom 122 of a least one tall side pan, such as the tall side pan 120C, and is connected to the drainage tube 114 which runs below the tall side pan 120C and the center catch pan 102C. At least one opening 110C, 110D extends through the end walls 126 of adjacent pans 120A, 120B, 120C. Just as with the center catch pans 102A, 102B, 102C described above, liquid entering into the tall side pan 120B can flow through the openings 110C, 110D in the end walls 126 into adjacent tall side pans 120A, 120C which contain the drains 112C, 112D, respectively. In the event that the openings 110C, 110D between the adjacent tall side pans 120A, 120B, 120C become blocked or overwhelmed by the flow of liquid, the liquid can overflow the shorter end walls 126 into the adjacent tall side catch pans. Further, if the drains 112C, 112D in the tall side pans 120A, 120C become blocked or otherwise non-functional, the tall, outside side wall 124 will direct the flow of liquid over the inside side wall 125 of the tall side pans 120A, 120B, 120C and over the adjacent rail 152A and into the center catch pans 102A, 102B, 102C, to allow the liquid to be contained.

In addition, embodiments of the catch pan system 100 may include a series of short side pans 130A, 130B, 130C attached end-to-end and located outside the opposite rail 152B. According to exemplary embodiments, each short side pan 130A, 130B, 130C has a bottom 132, two side walls 134, and two end walls 136. Just as in the other catch pans 102A-102C, 120A-120B described above, the end walls 136 are shorter in height than the side walls 134, and short side pans located at either end of the series of short side pans, such as the short side pan 130A, have an end plate 138 attached to their non-adjacent end walls 136 that raises the height of the end wall 136 to that of the side walls 134. A drain 112E, 112F extends through the bottom 132 of at least one short side pan, such as short side pan 130C, and is connected to the drainage tube 114. At least one opening 110E, 110F extends through the end walls 136 of the adjacent pans 130A, 130B, 130C. Although the center catch pans 102A, 102B, 102C alone are adequate to contain the maximum flow rates discussed herein, the addition of the short side pans 130A, 103B, 130C and tall side pans 120A, 120B, 120C provide additional coverage area for capturing leaks and spills of liquid on the railroad siding, as well as redundant containment mechanisms in the event that the center catch pan drains 112A, 112B become blocked, and the liquid overflows the rails 152A, 152B into the short side pans 130A, 130B, 130C and tall side pans 120A, 120B, 120C.

In one embodiment, the catch pans 102A-102C, 120A-120B, 130A-130C are made of carbon steel and lined with epoxy in order to resist corrosion and be substantially impervious to caustic chemicals. Each catch pan 102A-102C, 120A-120B, 130A-130C may be constructed up to 9 feet in length, allowing each pan to be cut and manufactured from a single, standard 5'×10' sheet of steel, in accordance with exemplary embodiments. It should be appreciated, however, that the pans can be manufactured from any number of materials and in any size depending upon the type of liquid being contained and other factors.

Figure 2:
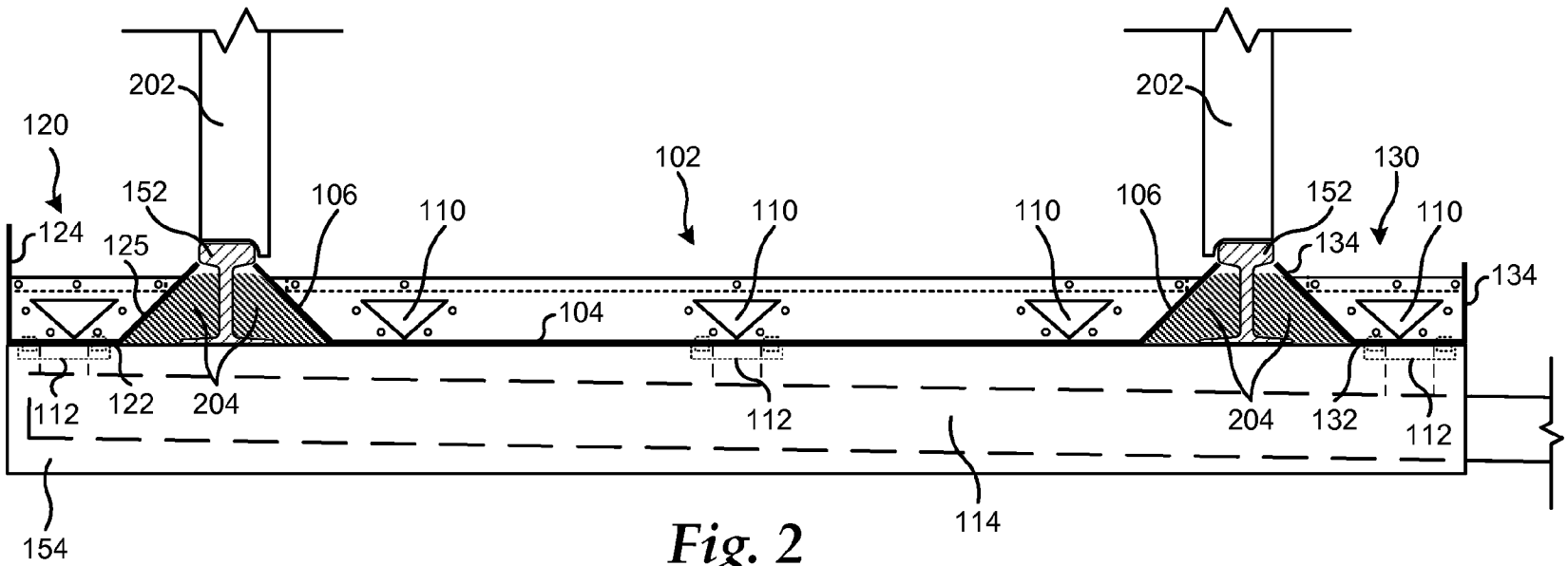
FIG. 2 is a cross-sectional view taken along line 2-2 of FIG. 1 showing the railroad siding with the catch pan system installed, according to various embodiments presented herein.

Turning now to FIG. 2, further details of the catch pan system 100, according to various embodiments presented herein will be described. FIG. 2 shows a cross-sectional view, taken generally along line 2-2 of FIG. 1, of the tall side pan 120, center catch pan 102, and short side pan 130 installed upon the cross-ties 154 of the railroad siding. The side walls 106 of the center catch pan 102 rise from the bottom 104 at an angle such that the top width of the center catch pan 102 is wider than the width of the bottom 104. In one embodiment, the angle of the side walls 106 to the bottom 104 is 135 degrees. This shape allows the bottom 104 of the center catch pan 102 to be positioned directly on the cross-ties 154 of the railroad siding between the foot and attachment means of each of the pair of rails 152, with the top of the side walls 106 positioned close to the head of the rails 152 but clear of wheels 202 of a rail tank car as is it travels along the railroad siding.

The space or gap between the center catch pan 102 and the adjacent rails 152 is filled with a gap filler material 204, such that liquid spilled directly upon the rail or overflowing the rail from the center catch pan 102 to the tall side pan 120 or short side pan 130 does not flow onto rail bed of the railroad siding. In one embodiment, the gap filler material 204 is a synthetic resin or polyurethane foam that can be easily introduced into the gap as a liquid but will expand and harden to form a resilient and impervious barrier. It will be appreciated by one of ordinary skill in the art that the choice of the gap filler material 204 will depend upon a number of factors, including the types of liquids or chemicals with which the material is likely to come into contact, the stability of the rail bed on which the railroad siding lies, and the climate of the area where the railroad siding is located.

In exemplary embodiments, the multiple openings 110 are located in the end walls 108 of the center catch pan 102. Each opening 110 is sized to provide for a maximum flow of liquid from pan to pan. In one embodiment, each opening 110 is sized to provide an open area greater than that of a 4" pipe drain. In a further embodiment, the openings 110 are triangular in shape with the widest width towards the top of the end wall 108, and an opposite vertex located nearly flush with the bottom 104 of the center catch pan 102. This configuration provides an opening 110 with the greatest area while minimizing the width of the opening close to the bottom 104 of the pan 102, where the gasket between the center catch pans is the thinnest, as described in more detail below. In addition, by placing the openings 110 nearly flush with the bottom 104 of the center catch pan 102, liquid entering the center catch pan 102 can flow to the adjacent catch pans immediately. This eliminates the build-up of "nuisance liquid" in the bottom of the pan 102 which could become trapped and have to be removed by means of a pump or other external method. It will be appreciated by one of ordinary skill in the art that the openings 110 may take any shape which immediately allows a liquid entering one of the pans 102 to flow into adjacent catch pans.

The tall side pan 120 and short side pan 130 are similarly shaped, with their respective side walls 125, 134 located adjacent to the rail 152 rising at a 135 degrees angle from the bottom 122, 132 in order to be positioned directly on the cross-ties 154 of the railroad siding clear of the foot and attachment means of the rail 152, with the top of the side wall 125, 134 positioned close to head of the rail 152. The gap between the tall side pan 120 or short side pan 130 and the adjacent rail 152 is filled with the gap filler material 204, as described above. The openings 110 in the tall side pan 120 and short side pan 130 are similarly shaped and positioned as those of the center catch pan 102, as described above. However, it will be appreciated by one of ordinary skill in the art that the openings 110 may take any shape which immediately allows a liquid entering one of the pans 120, 130 to flow into adjacent catch pans. It will be further appreciated that, while FIG. 2 illustrates the center catch pan 102 having three openings 110 and the tall side pan 120 and short side pan 130 each having one opening 110, any number of openings 110 may be provided allowing sufficient flow of liquid between adjacent pans.

As further illustrated in FIG. 2, the drains 112 located in the bottoms 122, 104, 132 of the tall side pan 120, center catch pan 102, and short side pan 130, respectively, are attached to the drainage tube 114 which runs underneath the pans between the adjacent cross-ties 154 of the railroad siding. In one embodiment, the drainage tube 114 is pitched downward as the tube runs from the tall side pan 120 under the center catch pan 102 and the short side pan 130, with the lower end being attached to the containment means.

Figure 3:
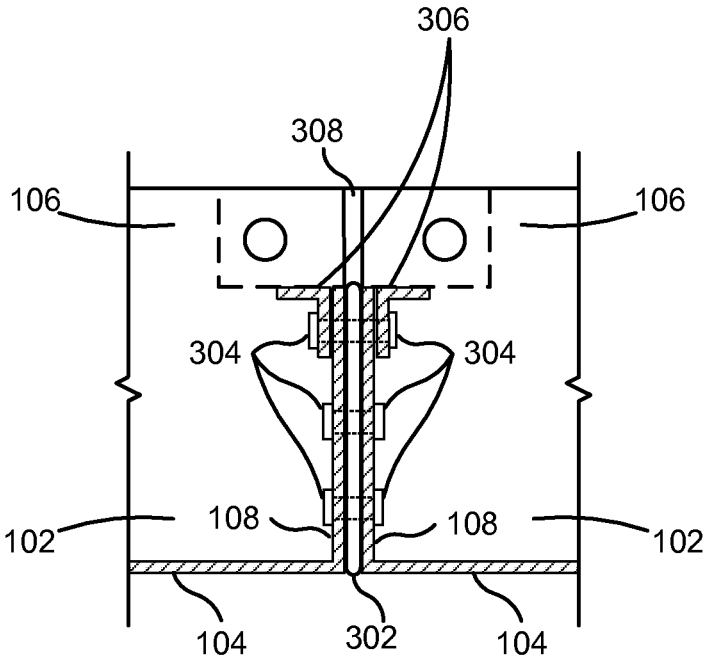
FIG. 3 is a cross-sectional view showing details of a method of attaching adjacent catch pans of the catch pan system, according to various embodiments presented herein.

FIG. 3 illustrates a means of attaching the adjacent center catch pans 102 of the catch pan system 100, according to exemplary embodiments. Two center catch pans 102 are attached end-to-end, with a gasket 302 placed between the adjacent end walls 108. The gasket 302 covers the full area of the end wall 108 and, in one embodiment, is made of ⅛" red silicon rubber. It will be appreciated, however, that the gasket material may vary depending on a number of factors, including the types of liquids or chemicals with which the gasket 302 is likely to come into contact and the climate of the area where the railroad siding is located. The openings 110 between adjacent center catch pans 102 pass through the gasket 302. Multiple connection members 304 attach the adjacent center catch pans 102 together, and pass through the end walls 108 of the adjacent catch pans as well as the gasket 302. Connection members 304 may consist of hex bolts and nuts, allowing the pans 102 to be disassembled to replace a damaged pan or to service the railroad siding underneath. In one embodiment, the top connection members 304 also attach a support angle bracket 306 on the inside of each end wall 108. The support angle bracket 306 provides support for optional bar grating (not shown) which may be placed over each catch pan 102, 120, 130 in the catch pan system 100.

Figure 4:
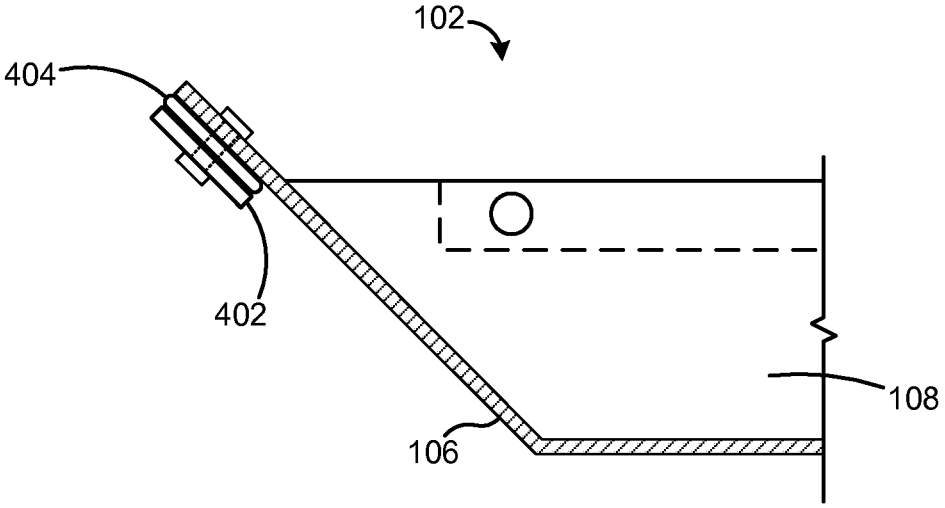
FIG. 4 is a cross-sectional view showing further details of a method of attaching adjacent catch pans of the catch pan system, according to various embodiments presented herein.

An area 308 between the side walls 106 of the adjacent center catch pans 102 above the end walls 108 is covered by a splice plate 402 and a gasket 404 of the same size, as shown FIG. 4. According to exemplary embodiments, the gasket 404 is made of ⅛" red silicon rubber. The splice plate 402 and gasket 404 prevent liquid from leaking outside of the adjacent center catch pans 102 in the event the liquid overflows the shorter end walls 108. Further, the means of attaching adjacent tall side pans 120 and adjacent short side pans 130 is substantially the same as the means of attaching center catch pans 102, as described in regard to FIGS. 3 and 4.

Figure 5:
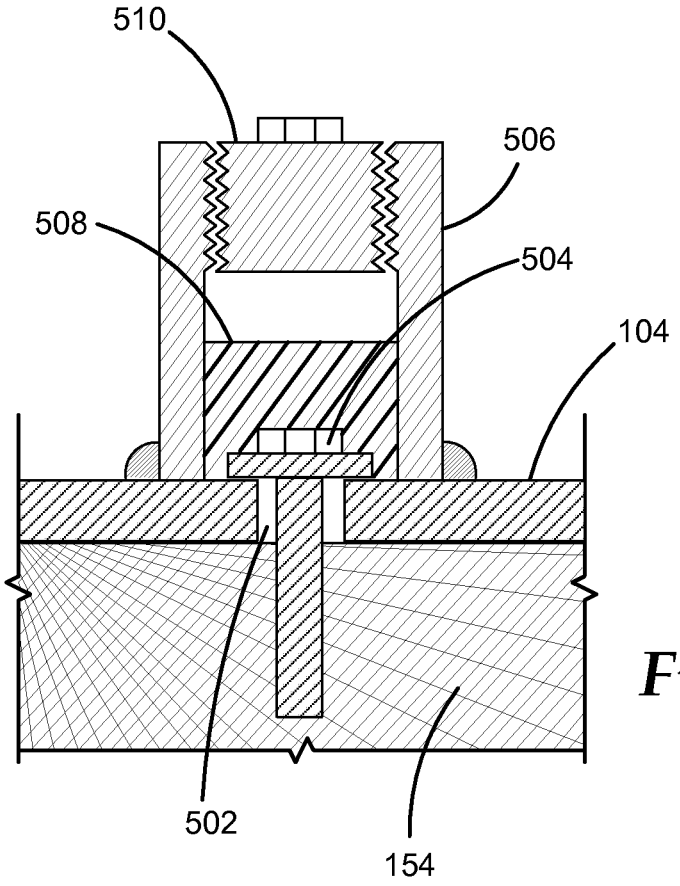
FIG. 5 is a cross-sectional view showing details of a method of attaching the catch pans of the catch pan system to the cross-ties of the railroad siding, according to various embodiments presented herein.

FIG. 5 illustrates the sealed connection member 116 used to attach a catch pan, such as the center catch pan 102, to the underlying cross-tie 154, according to one embodiment. Each catch pan 102, 120, 130 is attached to an underlying cross-tie 154 at various points by passing a lag bolt 504 through a hole 502 in the bottom 104 of the catch pan 102 and into the cross-tie 154. In order to prevent liquid from leaking from the bottom 104 of the catch pan 102 through the hole 502, the hole 502 and lag bolt 504 are surrounded by a pipe coupling 506 welded to the bottom 104 of the pan 102. The pipe coupling 506 is sealed with a plug 510. In another embodiment, the inside of the pipe coupling 506 is filled with a synthetic resin or polyurethane foam 508 to act as a further barrier to liquid escaping the catch pan 102 through the hole 502.

This method of attaching the catch pans 102, 120, 130 of the catch pan system 100 to the underlying cross-ties 154 of the railroad siding allows the catch pans to be removed in the event that maintenance to the railroad siding is required, without damaging the catch pans or the siding. However, it will be obvious to one of ordinary skill in the art that other methods of attaching the catch pans 102, 120, 130 to the underlying cross-ties 154 could be used, including adhesive.

Figure 6:
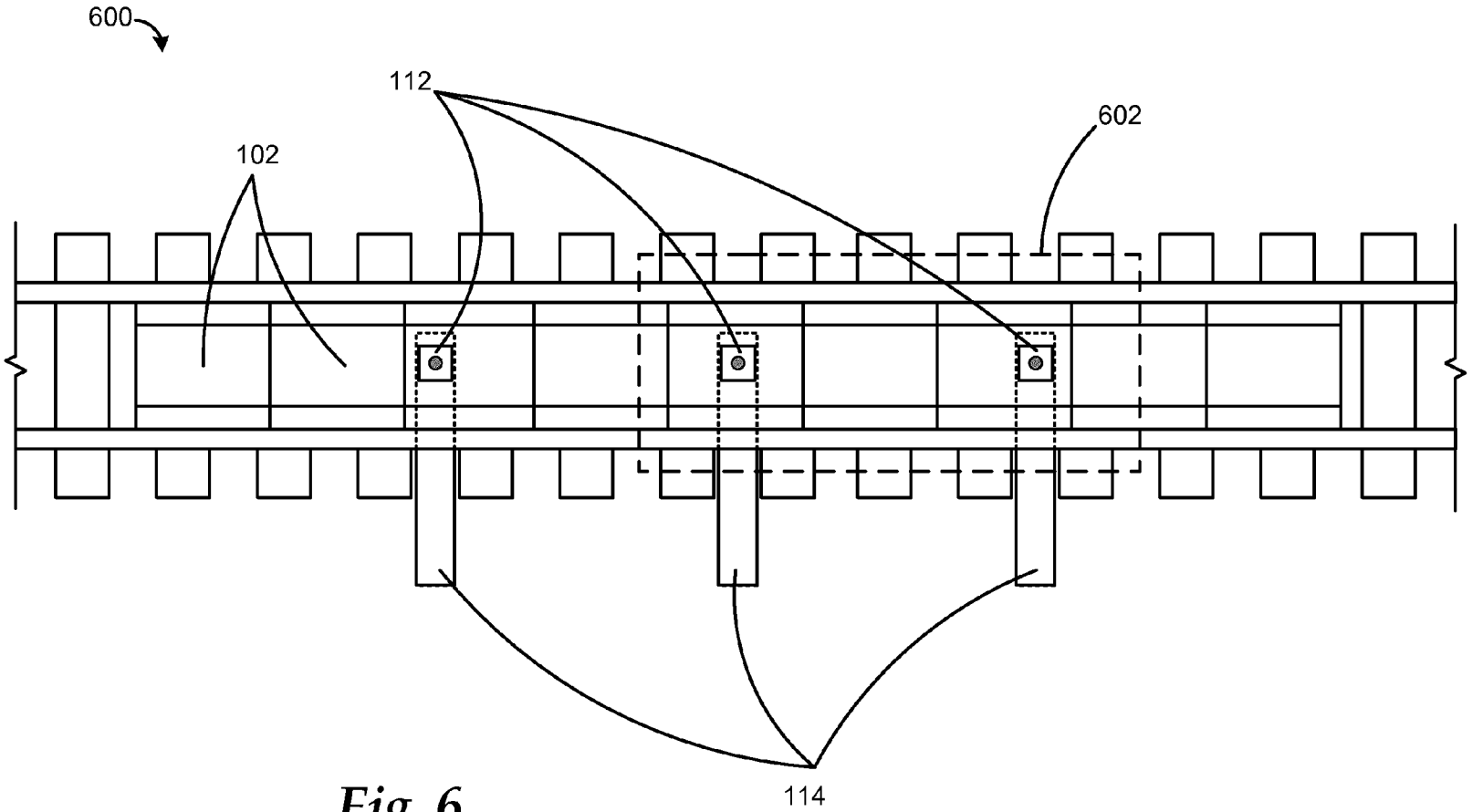
FIG. 6 is a top plan view showing a representative configuration of the catch pan system on a railroad siding, according to various embodiments presented herein.

FIG. 6 illustrates a representative configuration 600 of the catch pan system 100, according to various embodiments presented herein. The depicted configuration 600 consists of nine center catch pans 102 connected together as described above, covering the entire loading/unloading area of the railroad siding. Three of the center catch pans 102 include the drains 112, which connect through the drainage tubes 114 to a containment means capable of holding the entire contents of a rail tank car, such as a lined retaining ditch or holding tank. A spill of a liquid from a rail tank car, depicted by a box 602, located anywhere on the siding would be caught by one of the underlying center catch pans 102 and would flow from catch pan to catch pan and into one or more of the drains 112 included in the configuration 600. This representative configuration provides the capacity and redundancy to ensure that any catastrophic spill of the entire contents of a rail tank car could be caught and contained, and thus would allow for the safe, un-attended loading or unloading of rail tank cars on the railroad siding.

Figure 7:
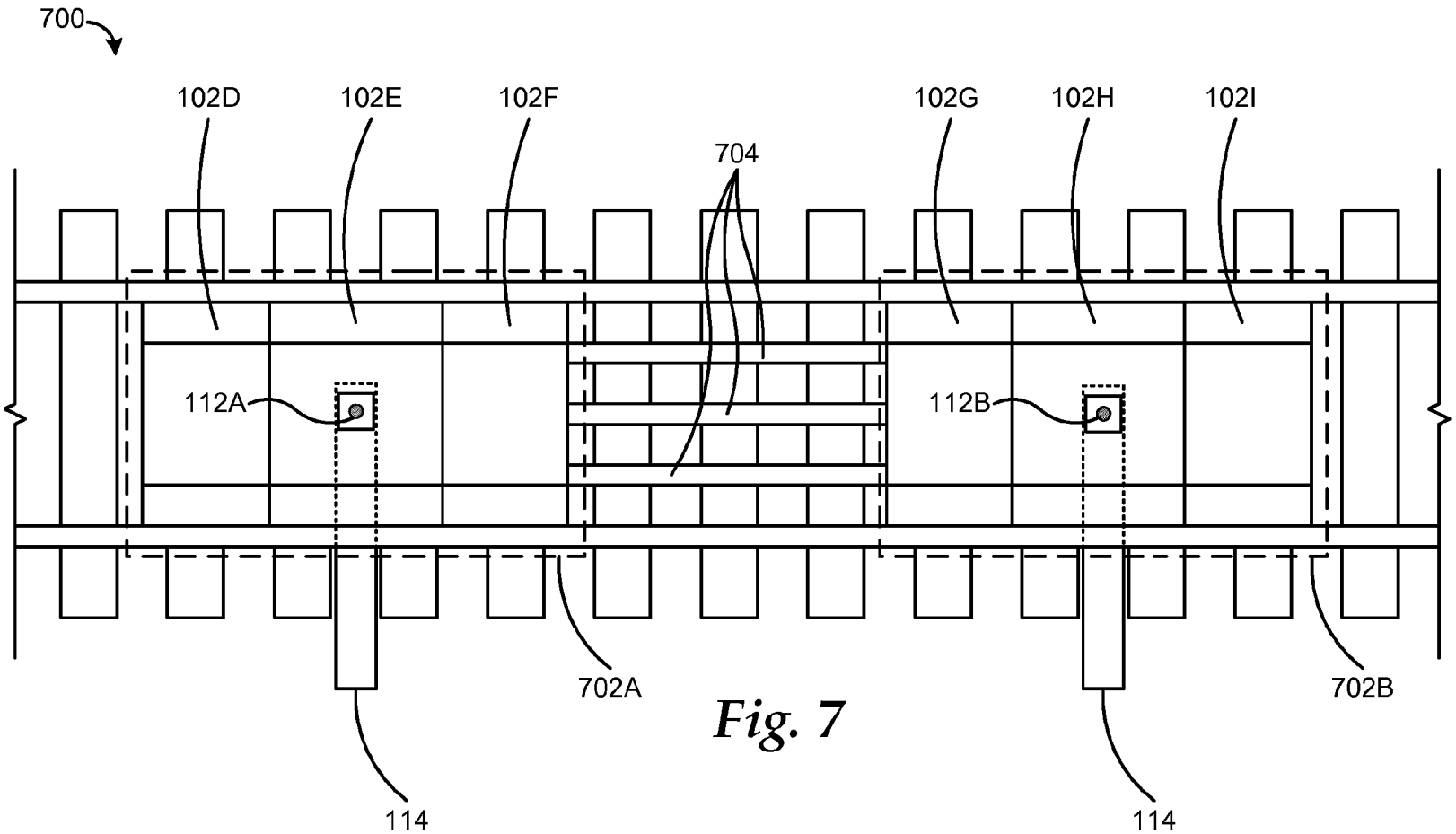
FIG. 7 is a top plan view showing an alternative configuration of the catch pan system on a railroad siding, according to various embodiments presented herein.

An alternative configuration 700 of the catch pan system 100 is illustrated in FIG. 7. This configuration 700 consists of two sets of three center catch pans 102D-102F and 102G-102I. The center catch pan 102E, 102H in each set of three includes a drain 112, which connects through the drainage tube 114 to the containment. Between the two sets of center catch pans 102D-102F and 102G-102I are three pipes 704, each connecting one of the openings 110 in the inside center catch pan of the first set 102F to the opposing opening 110 in the inside center catch pan of the second set 102G. Although three pipes 704 are illustrated, the number of pipes will depend on the number of openings 110. The configuration 700 illustrated in FIG. 7 provides coverage for two positions for the loading/unloading of rail tank cars, represented by blocks 702A and 702B, while requiring only six center catch pans 102D-102F and 102G-102I and two drains 112. This configuration has the advantage of reduced cost of installation while maintaining the capability and redundancy to handle a catastrophic spill of a liquid from a rail tank car. Many more configurations, including combinations of the center catch pans 102, tall side pans 120, and short side pans 130 can be imagined by one of ordinary skill in the art, depending on the length of the railroad siding, the number of rail tank cars to be loaded or unloaded, the budget for the installation, etc.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A catch pan apparatus for catching and containing a spill of a liquid, comprising:

a bottom;

a first side wall adjoined to and extending upward from the bottom at a perimeter of the catch pan apparatus;

a second side wall adjoined to and extending upward from the bottom at the perimeter of the catch pan apparatus, the second side wall opposite of the first side wall;

a first end wall adjoined to and extending upward from the bottom at the perimeter of the catch pan apparatus, the first end wall substantially perpendicular to the first side wall and having a height less than that of the first and second side walls;

a second end wall adjoined to and extending upward from the bottom at the perimeter of the catch pan apparatus, the second end wall opposite of the first end wall and having a height less than that of the first and second side walls; and an opening in each of the first and second end walls, the opening extending substantially to the bottom and configured to allow the liquid to flow into an adjacently attached catch pan.

2. The catch pan apparatus of claim 1, wherein the first and second side walls extend upward from the bottom of the catch pan apparatus at an angle substantially less than perpendicular and away from the opposite side wall.

3. The catch pan apparatus of claim 1, wherein a distance between the first side wall and the second side wall is substantially equivalent to a distance between a pair of rails of a railroad track.

4. The catch pan apparatus of claim 1, wherein the catch pan is formed from a single sheet of a material, cut and folded to form the bottom, the first side wall, the second side wall, the first end wall, and the second end wall of the catch pan apparatus.

5. A system for catching and containing a spill of a liquid from a rail tank car located upon a railroad track, comprising:

a plurality of catch pans placed end-to-end, between and parallel to a pair of rails of the railroad track, each catch pan comprising a bottom, side walls, and end walls, the end walls being shorter than the side walls;

a sealing member placed between adjacent catch pans;

at least one opening extending through each of the end walls and the sealing member between adjacent catch pans, the opening extending substantially to the bottom of the catch pans and configured to allow the liquid to flow from pan to pan;

a drain depending from the bottom of at least one of the plurality of catch pans; and an end wall extension member attached to one of the end walls of one of the plurality of catch pans at an end of the plurality of catch pans, the end wall extension member configured to extend the height of the end wall to the height of the side walls.

6. The system of claim 5, wherein each of the plurality of catch pans is attached to an adjacent catch pan by a plurality of connecting members.

7. The system of claim 5, wherein the drain is connected to a liquid containment means.

8. The system of claim 5, wherein each of the plurality of catch pans is fastened to at least one of a plurality of cross-ties of the railroad track.

9. The system of claim 5, further comprising:

a plurality of short side pans placed end-to-end, parallel to and outside of the pair of rails, each short side pan comprising a bottom, side walls, and end walls, the end walls of the plurality of short side pans being shorter than the side walls of the plurality of short side pans;

a sealing member placed between adjacent short side pans;

an opening extending through each of the end walls of the plurality of short side pans and the sealing member between adjacent short side pans, the opening extending substantially to the bottom of the plurality of short side pans; and a drain depending from the bottom of at least one of the plurality of short side pans.

10. The system of claim 9, further comprising:

a plurality of tall side pans placed end-to-end, parallel to and on an opposite side of the pair of rails from the short side pans, each tall side pan comprising a bottom, a first side wall adjoined to the bottom at a position adjacent to one of the pair of rails, a second side wall adjoined to the bottom at a position opposite of the first side wall and having a height greater than that of the first side wall, a first end wall adjoined to the bottom and at a position substantially perpendicular to the first and second side walls, and a second end wall adjoined to the bottom and at a position opposite of the first end wall, the first and second end walls having a height less than that of the first side wall;

a sealing member placed between adjacent tall side pans;

an opening extending through each of the end walls of the plurality of tall side pans and the sealing member between adjacent tall side pans, the opening extending substantially to the bottom of the plurality of tall side pans; and a drain depending from the bottom of at least one of the plurality of tall side pans.

11. A catch pan apparatus for catching and containing a spill of a liquid, comprising:

a bottom;

a first side wall adjoined to and extending upward from the bottom;

a second side wall adjoined to and extending upward from the bottom, the second side wall opposite of the first side wall;

a first end wall adjoined to and extending upward from the bottom, the first end wall substantially perpendicular to the first side wall and having a height less than that of the first side wall;

a second end wall adjoined to and extending upward from the bottom, the second end wall opposite of the first end wall and having a height less than that of the first side wall; and an opening in each of the first and second end walls configured to allow the liquid to flow into an adjacently attached catch pan, wherein the opening is substantially triangular with a widest side positioned near a top of the end wall and an opposite vertex positioned substantially at the bottom of the catch pan apparatus.

12. A catch pan apparatus for catching and containing a spill of a liquid, comprising:

a bottom;

a first side wall adjoined to and extending upward from the bottom;

a second side wall adjoined to and extending upward from the bottom, the second side wall opposite of the first side wall;

a first end wall adjoined to and extending upward from the bottom, the first end wall substantially perpendicular to the first side wall and having a height less than that of the first side wall;

a second end wall adjoined to and extending upward from the bottom, the second end wall opposite of the first end wall and having a height less than that of the first side wall;

an opening in each of the first and second end walls configured to allow the liquid to flow into an adjacently attached catch pan;

an aperture passing through the bottom; and a tubular member with a bottom end affixed to the bottom and a top end open, the tubular member enclosing the aperture, wherein the bottom of the catch pan apparatus is affixed to one or more cross-ties of a railroad track by passing a fastening member through the aperture enclosed in the tubular member.

13. The catch pan apparatus of claim 12, further comprising a sealing member configured to be attached to the top end of the tubular member and operative to seal the top end of the tubular member after the fastening member is passed through the aperture in the bottom of the catch pan apparatus.

* * * * *